US011087724B1

(12) United States Patent
McBride

(10) Patent No.: US 11,087,724 B1
(45) Date of Patent: Aug. 10, 2021

(54) SPRING LOADED THUMB PICK

(71) Applicant: Cole Eshee Heve McBride, Vancouver (CA)

(72) Inventor: Cole Eshee Heve McBride, Vancouver (CA)

( * ) Notice: Subject to any disclaimer, the term of this patent is extended or adjusted under 35 U.S.C. 154(b) by 0 days.

(21) Appl. No.: 16/811,705

(22) Filed: Mar. 6, 2020

Related U.S. Application Data

(63) Continuation-in-part of application No. 29/669,528, filed on Nov. 8, 2018, now Pat. No. Des. 877,805.

(51) Int. Cl.
*G10D 3/173* (2020.01)

(52) U.S. Cl.
CPC ..... *G10D 3/173* (2020.02)

(58) Field of Classification Search
CPC ..... G10D 3/176
USPC ..... 84/322
See application file for complete search history.

(56) References Cited

U.S. PATENT DOCUMENTS 557,293 A * 3/1896 Wahl ..... G10D 3/173 84/322
2,063,011 A * 12/1936 Bell ..... G10D 3/173 84/322
2,776,592 A * 1/1957 Di Preta ..... G10D 3/173 84/322
3,442,169 A * 5/1969 Bowers ..... G10D 3/173 84/322
3,648,558 A * 3/1972 Chenette ..... G10D 3/173 84/322
3,789,720 A * 2/1974 McIntyre ..... G10D 3/173 84/322
4,015,502 A 4/1977 Strong
4,020,732 A * 5/1977 Kelly ..... G10D 3/173 84/322
4,122,746 A 10/1978 Freeman
4,270,433 A * 6/1981 Adamec ..... C07F 9/4075 84/322
4,497,237 A * 2/1985 Beall ..... G10D 3/173 84/322
4,625,616 A 12/1986 McVicker
4,651,614 A 3/1987 Cavallo
D291,809 S * 9/1987 Jasper ..... 84/322
4,711,150 A * 12/1987 Hyduck ..... G10D 3/173 84/322
4,741,239 A * 5/1988 Crafton ..... G10D 3/173 84/322
4,779,778 A 10/1988 Nixon, II
4,867,032 A 9/1989 Lukehart
(Continued)

*Primary Examiner* — Christina M Schreiber
(74) *Attorney, Agent, or Firm* — Quickpatents, LLC; Kevin Prince

(57) ABSTRACT

A thumb pick for wearing on the thumb of a musician to strum guitar strings includes a pick having a front side, a rear side, a lower side terminating in a rounded point, and an upper side terminating at a pivot mechanism. A retaining ring has an inside surface, an outside surface, an upper side terminating at the pivot mechanism, and a lower side. The pivot mechanism includes two or more knuckles fixed with the upper side of the pick, two or more knuckles fixed with the upper side of the retaining ring, a pin traversing aligned apertures formed through the knuckles, and a coil spring urging the retaining ring towards the pick. In use, the musician wears the thumb pick encircling his thumb, so that he can strum the guitar strings with the pick.

20 Claims, 4 Drawing Sheets

(56) References Cited

U.S. PATENT DOCUMENTS 4,890,531 A * 1/1990 Tischer ..... G10D 3/173 84/329
5,253,562 A 10/1993 Kline
5,413,020 A * 5/1995 Thompson ..... G10D 3/173 84/329
5,509,341 A * 4/1996 Dunlop ..... G10D 3/173 84/322
5,837,913 A * 11/1998 Newman ..... G10D 3/173 84/329
5,864,075 A * 1/1999 Mapson ..... G10D 3/173 84/322
5,973,243 A * 10/1999 Christenson ..... G10D 3/173 84/322
6,054,643 A * 4/2000 Chance ..... G10D 3/173 84/322
6,225,539 B1 5/2001 Freeman
6,242,677 B1 * 6/2001 Sander ..... G10D 3/173 84/322
6,259,009 B1 * 7/2001 Bolo, III ..... G10G 5/005 84/329
6,701,746 B1 * 3/2004 Bentley ..... A44C 9/0038 63/12
6,949,700 B1 * 9/2005 Kelly ..... G10D 3/173 84/322
6,977,330 B2 * 12/2005 Santa Cruz ..... G10D 3/173 84/322
7,017,368 B2 * 3/2006 Hug ..... A44C 5/12 63/15
7,157,635 B2 1/2007 Sogabe
7,589,267 B1 * 9/2009 Sims ..... G10D 3/173 84/320
D603,891 S * 11/2009 Whetstine ..... D17/20
7,799,979 B2 * 9/2010 Swartz ..... G10D 3/173 84/322
7,847,171 B1 * 12/2010 Kidd, III ..... G10D 3/173 84/329
D632,729 S * 2/2011 Goad ..... D17/20
7,977,557 B2 * 7/2011 Broderick ..... G10D 3/173 84/322
8,389,839 B2 3/2013 McVicker
8,492,630 B1 * 7/2013 Wonnacott ..... G10D 3/173 84/320
8,664,498 B2 * 3/2014 Leneman ..... G10D 3/173 84/322
8,716,581 B1 * 5/2014 Boyd ..... G10D 3/173 84/329
8,962,959 B1 2/2015 Mier
9,089,191 B1 * 7/2015 Farnum ..... A44C 9/0061
9,135,897 B2 * 9/2015 McDonald ..... G10D 3/173
9,240,167 B2 * 1/2016 Caccia ..... G10D 3/173
9,418,633 B1 * 8/2016 Storck ..... G10D 3/173
9,472,172 B1 * 10/2016 Nassab ..... B65D 83/0817
9,734,805 B1 * 8/2017 Caccia ..... G10D 3/173
9,997,145 B1 * 6/2018 Rubenstein ..... G10D 3/173
10,210,849 B1 * 2/2019 Britt ..... G10D 3/173
D877,805 S * 3/2020 McBride ..... D17/20
10,706,826 B1 * 7/2020 Sweeney ..... G10D 3/173
2002/0178891 A1 * 12/2002 Atkin ..... G10D 3/173 84/322
2003/0047058 A1 * 3/2003 Pearson-Bey ..... G10D 3/173 84/322
2006/0086231 A1 4/2006 Sielaff
2006/0117931 A1 * 6/2006 Benyahia ..... G10D 3/173 84/322
2006/0156895 A1 * 7/2006 Judd ..... G10D 3/173 84/320
2009/0084244 A1 4/2009 Goad
2009/0139384 A1 * 6/2009 Bramucci ..... G10D 3/173 84/322
2009/0217497 A1 * 9/2009 Lans, V ..... A47G 29/083 24/499
2009/0229442 A1 9/2009 Hollin, Jr.
2013/0199354 A1 8/2013 Yavorski
2013/0312639 A1 * 11/2013 Hobbs ..... C09J 105/00 106/205.71
2015/0122106 A1 * 5/2015 Spivey ..... G10D 3/173 84/322
2015/0255050 A1 * 9/2015 Diaz Lopez ..... G10D 3/173 84/322
2015/0294653 A1 * 10/2015 Harrington ..... G10D 3/173 84/322
2017/0053627 A1 2/2017 Spivey
2017/0116969 A1 4/2017 Knapp
2017/0178606 A1 6/2017 Calder

* cited by examiner

SPRING LOADED THUMB PICK

CROSS-REFERENCE TO RELATED APPLICATIONS

This application is a Continuation-in-Part of Design Patent Application 29/669,528, filed on Nov. 8, 2018, and incorporated herein by reference.

STATEMENT REGARDING FEDERALLY SPONSORED RESEARCH AND DEVELOPMENT

Not Applicable.

FIELD OF THE INVENTION

This invention relates to guitar picks, and more particularly to a spring-loaded guitar pick.

BACKGROUND

Conventional thumb picks that are integrally formed from a single plastic material and that are looped around a musician's thumb are notorious for quickly wearing and needing replacement. Such prior art thumb picks must be relatively thin to be flexible enough to properly accommodate both upward and downward strums on guitar strings.

Plastic thumb picks of the prior art warm up and loosen around a players thumb from shock of the pick against the strings and the musician's body temperature expanding the plastic. The ring opens and loosens over time and sometimes breaks. Further, a retention ring portion of such prior art devices can contact and deform the pick portion of such prior art devices over time, resulting in inconsistent guitar picking characteristics. Moreover, prior art devices must be sized to fit the particular musician, and a one-size-fits-all pick is not available.

Therefore, there is a need for a device that allows a relatively thick pick to be used that is spring-loaded with the retention ring to provide the feel of flexibility while playing but while providing more consistent strumming through prolonged use. Such a needed invention would fit a wide variety of thumb sizes, and would not feel looser during extended play due to its thickness compared with prior art picks. Such a needed invention would be more durable than prior art devices and less prone to breakage. The present invention accomplishes these objectives.

SUMMARY OF THE INVENTION

The present device is a thumb pick for wearing on the thumb of a musician to strum guitar strings, or the strings of similar instruments. A pick has a front side, a rear side, a lower side terminating in a rounded point, and an upper side terminating at a pivot mechanism. A retaining ring has a concave inside surface, a convex outside surface, an upper side terminating at the pivot mechanism, and a lower side.

The pivot mechanism includes two or more knuckles fixed with the upper side of the pick, two or more knuckles fixed with the upper side of the retaining ring, and a pin traversing aligned apertures formed through the knuckles. The pivot mechanism further includes a biasing element, such as a metallic coil spring, or the like. The biasing element is preferably disposed about the pin between two of the knuckles that are fixed to the pick.

Preferably at least one of the knuckles of the pick includes an extension stop to prevent the retaining ring from pivoting away from the pick beyond a predetermined angle $\alpha$, such as 25-degrees or even 15-degrees. Similarly, at least one of the knuckles of the pick includes a retraction stop to prevent the retaining ring from forcefully contacting the pick, thereby inhibiting damage to the pick caused by repeated forceful contact with the ring under the force of the biasing element. A ring stop of the retaining ring is free to move between the extension stop and the retraction stop as the retaining ring moves between the extended configuration and the retracted configuration.

In use, the musician wears the thumb pick encircling his thumb, so that he can strum the guitar strings with the pick in an upward direction, or in a downward direction. In both cases the retaining ring allows the pick to be less rigidly held by the musician so that the pick acts like a relatively thin, flexible pick, even though the thickness of the pick is preferably at least 0.8 mm, by slightly opening toward the extended configuration when the pick is moved in an upward direction across the guitar strings.

The present invention is a device that allows a relatively thick pick to be used that is spring-loaded with the retention ring to provide the feel of flexibility while playing but while providing more consistent strumming through prolonged use. The present device fits a wide variety of thumb sizes, and does not feel looser during extended play due to its thickness compared with prior art picks and its relative indifference to heat. The present invention is more durable than prior art devices as contact is inhibited between the ring and the pick. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
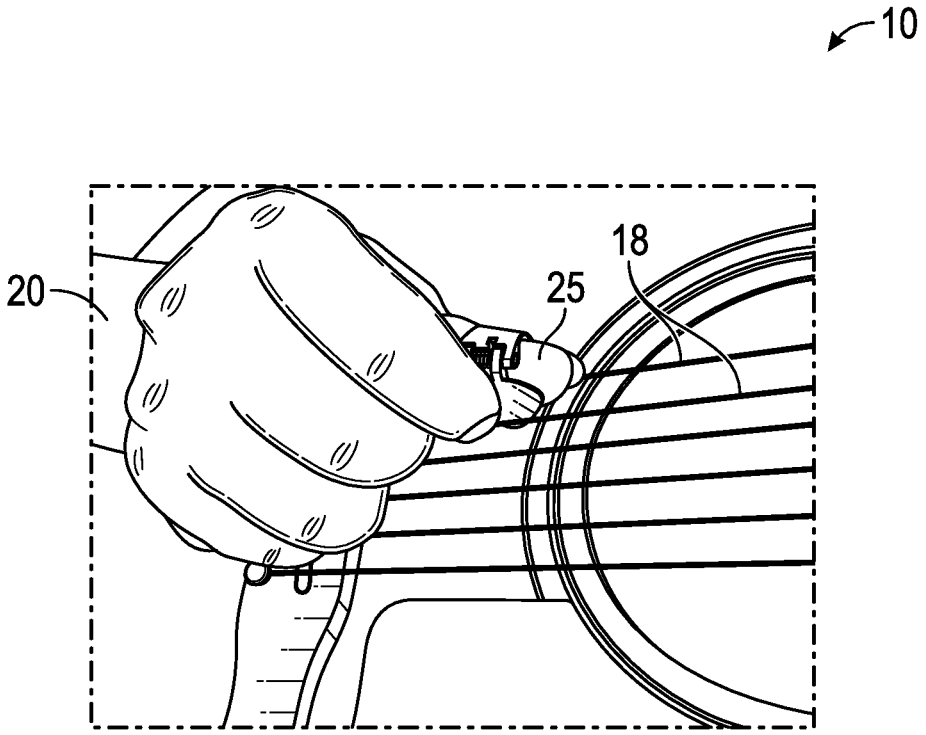
FIG. 1 is a perspective view of the invention, illustrating a musician using the invention to strum a guitar string in a downward direction.
Figure 2:
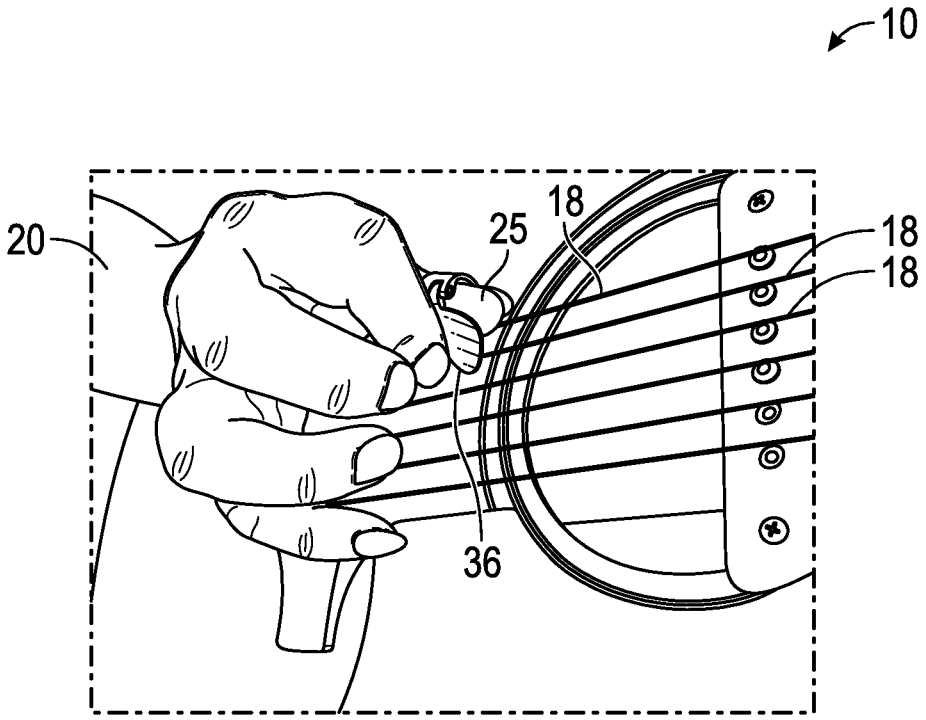
FIG. 2 is a perspective view of the invention, illustrating a musician using the invention to strum a guitar string in an upward direction.
Figure 3:
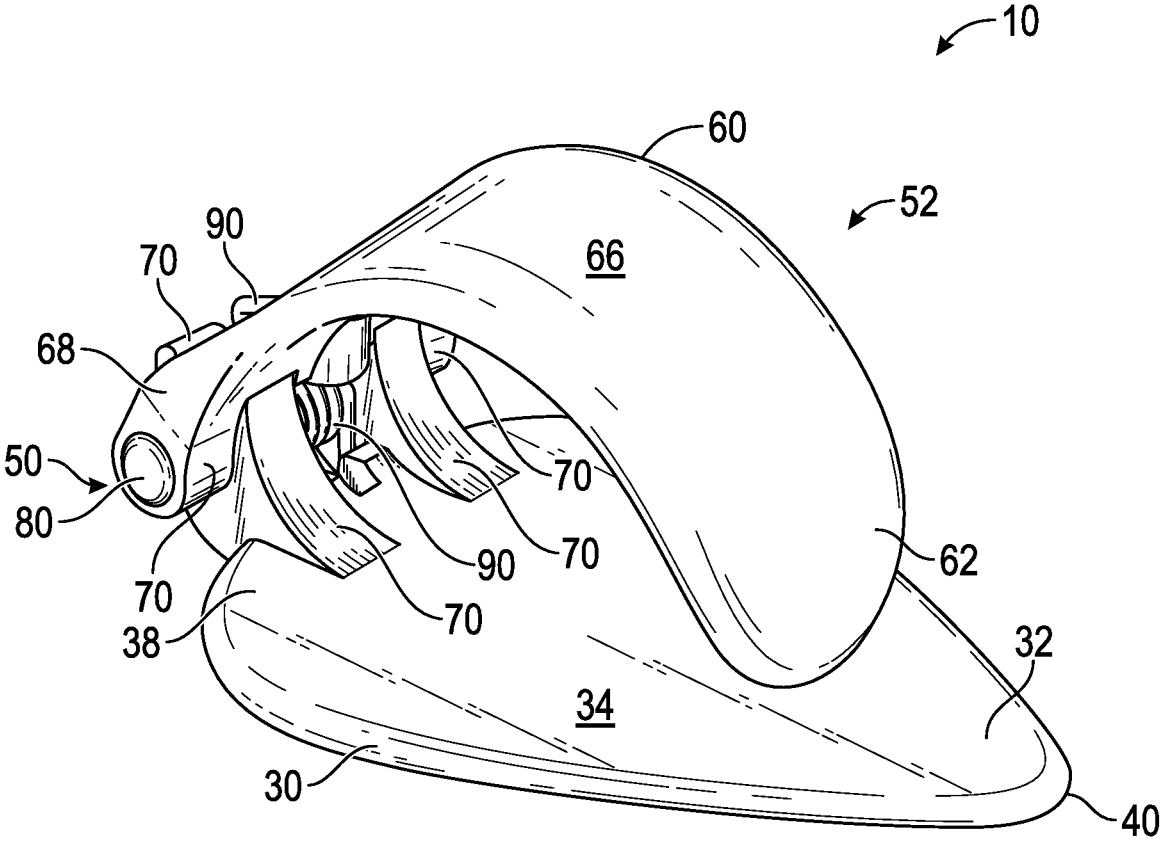
FIG. 3 is a perspective view of the invention in a retracted configuration.
Figure 4:
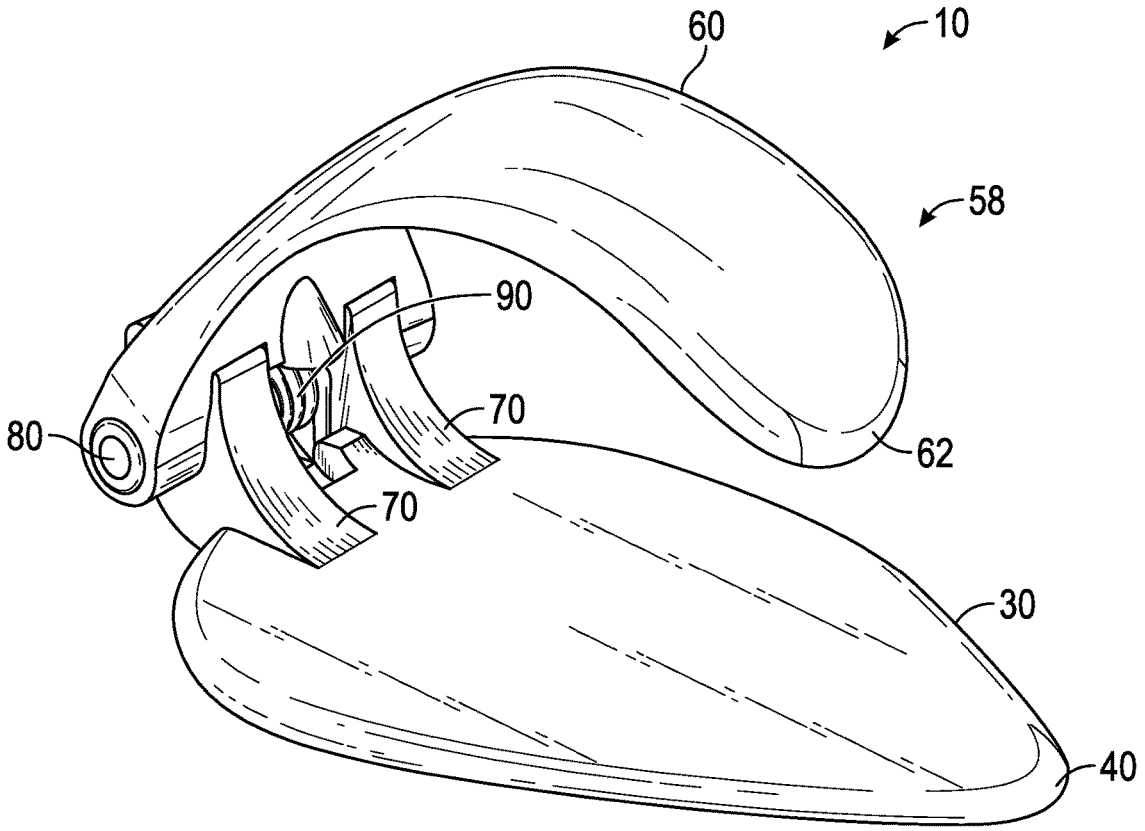
FIG. 4 is a perspective view of the invention in an extended configuration.
Figure 5:
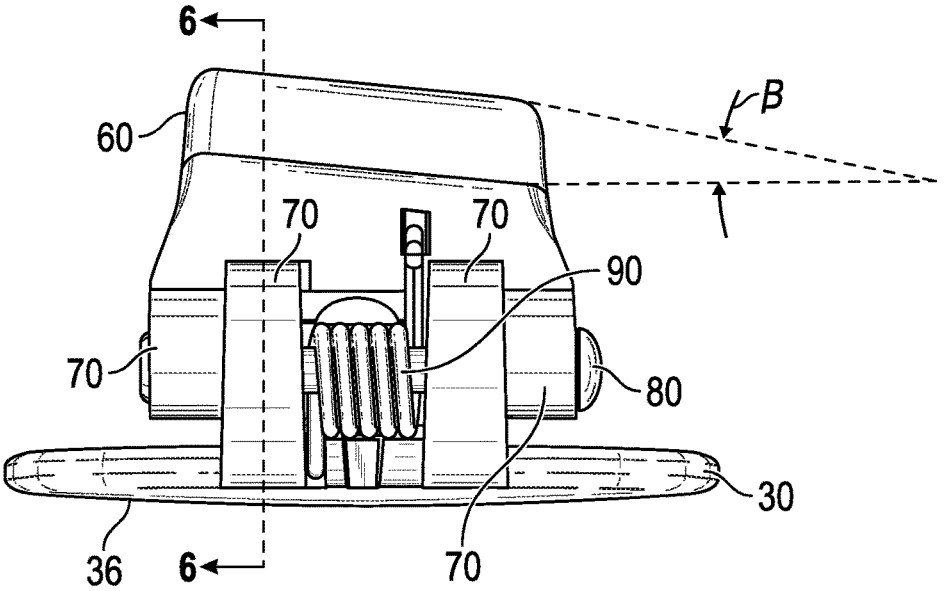
FIG. 5 is a rear elevational view of FIG. 3.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate a thumb pick 10 for wearing on the thumb 25 of a musician 20 to strum guitar strings 18, or the strings of similar instruments. A pick 30 has a front side 34, a rear side 36, a lower side 32 terminating in a rounded point 40, and an upper side 38 terminating at a pivot mechanism 50.

A retaining ring 60 has a concave inside surface 64, a convex outside surface 66, an upper side 68 terminating at the pivot mechanism 50, and a lower side 62. In some embodiments the retaining ring 60 is tapered to accommodate a slope β of the musician's thumb 25.

The pivot mechanism 50 includes two or more knuckles 70 fixed with the upper side 38 of the pick 30, two or more knuckles 70 fixed with the upper side 68 of the retaining ring 60, and a pin 80 traversing aligned apertures formed through the knuckles 70. The pivot mechanism 50 further includes a biasing element 90, such as a metallic coil spring, a resilient plastic flat spring (not shown), or the like. The biasing element 90 is preferably disposed about the pin 80 between two of the knuckles 70 that are fixed to the pick 30. The biasing element 90 urges the lower end 62 of the retaining ring 60 towards the front side 34 of the pick 30.

Preferably at least one of the knuckles 70 of the pick 30 includes an extension stop 100 (FIGS. 6A and 6B) to prevent the retaining ring 60 from pivoting away form the pick 30 beyond a predetermined angle α, such as 25-degrees or even 15-degrees. Similarly, at least one of the knuckles 70 of the pick 30 includes a retraction stop 110 to prevent the retaining ring 60 from forcefully contacting the pick 30 (FIG. 6A), although the lower side 62 of the retaining ring 60 just slightly contacts or is just slightly apart from the front side 34 of the pick 30 when the thumb pick 10 is in the retracted configuration 52, thereby keeping the pick 30 from being damaged by frequent contact with the retaining ring 60 under force of the biasing element 90. A ring stop 61 of the retaining ring 60 is free to move between the extension stop 100 and the retraction stop 110 as the retaining ring 60 moves between the extended configuration 58 and the retracted configuration 52.

Alternately, the ring stop 61 could be included on one of the knuckles of the pick 30 and the extension stop 100 and the retraction stop 110 could be included on the knuckles 70 of the retaining ring 60, or on the retaining ring 60 itself.

Figure 6A:
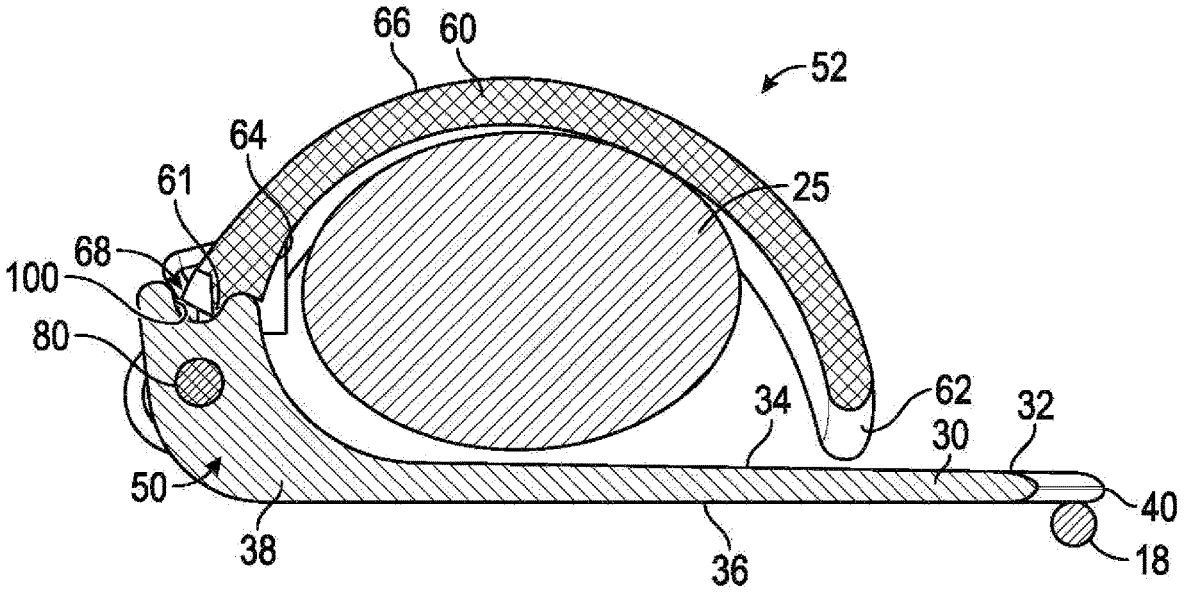
FIG. 6A is a cross-sectional view of the invention, taken along lines 6-6 of FIG. 5, and illustrating the invention in the retracted configuration.
Figure 6B:
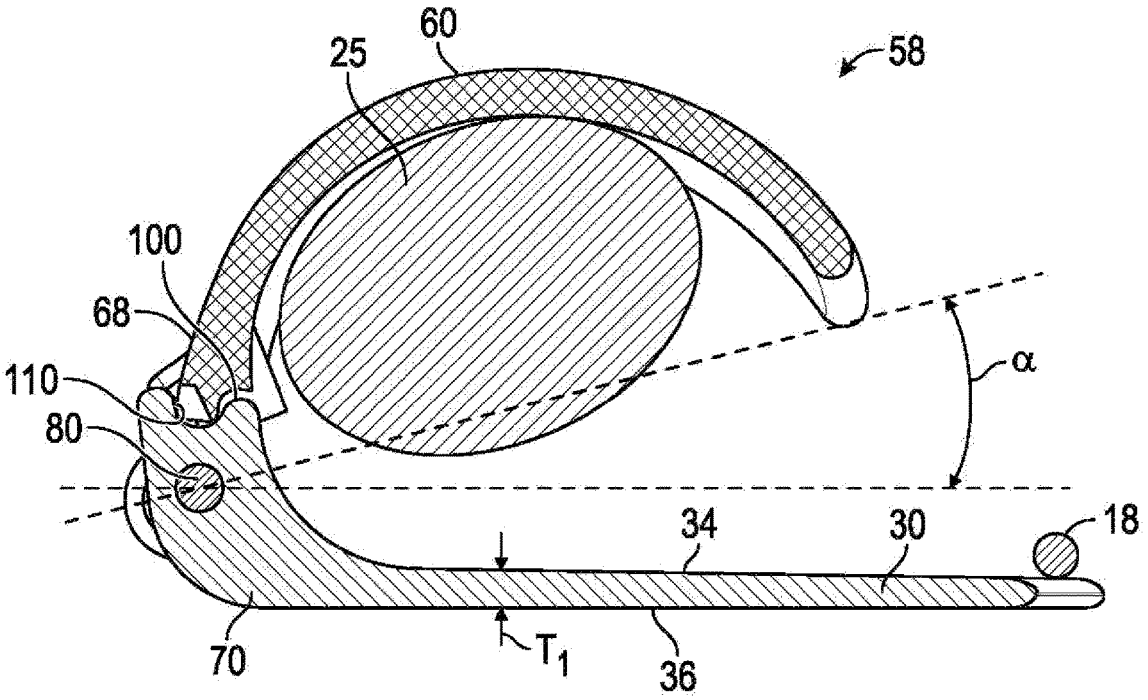
FIG. 6B is a cross-sectional view of the invention, taken along lines 6-6 of FIG. 5, and illustrating the invention in the extended configuration.

In use the musician 20 wears the thumb pick 10 encircling his thumb 25, so that he can strum the guitar strings 18 with the pick 30 in an upward direction (FIGS. 2 and 6B), or in a downward direction (FIGS. 1 and 6A). In both cases the retaining ring 60 allows the musician 20 additional freedom in how he holds the pick 30, even though the thickness $T_1$ of the pick 30 is preferably at least 0.8 mm, by slightly opening toward the extended configuration 58 when the pick 30 is moved in an upward direction across the guitar strings 18.

Preferably the pick 30 and associated knuckles 70 are integrally formed with an injection-molded plastic material. Similarly, the retaining ring 60 and associated knuckles 70 are preferably integrally formed with an injection-molded plastic material. The pin 80 may be a rigid plastic material, but is preferably made from a rigid metallic material for strength.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A thumb pick for a musician's thumb to strum guitar strings, comprising:

a pick having a front side, a rear side, a lower side terminating in a rounded point, an upper side terminating at a pivot mechanism;

a retaining ring having a concave inside surface, a convex outside surface, an upper side terminating at the pivot mechanism, and a lower side; and the pivot mechanism including two or more knuckles fixed with the upper side of the pick, two or more knuckles fixed with the upper side of the retaining ring, and a pin traversing aligned apertures formed through the knuckles, the pivot mechanism further including a biasing element that urges the retaining ring towards the pick, wherein the concave inside surface faces the front side of the pick;

whereby with the musician wearing the thumb pick encircling his thumb, he can strum the guitar strings with the pick.

2. The thumb pick of claim 1 wherein at least one of the knuckles of the pick includes an extension stop to prevent the retaining ring from pivoting away from the pick beyond a predetermined angle.

3. The thumb pick of claim 2 wherein the predetermined angle is less than about 25-degrees.

4. The thumb pick of claim 1 wherein at least one of the knuckles of the pick includes a retraction stop to reduce or eliminate pressure of the retaining ring against the pick.

5. The thumb pick of claim 1 wherein the pick has a thickness of at least 0.8 mm.

6. The thumb pick of claim 1 wherein the retaining ring is tapered to accommodate a slope of the musician's thumb.

7. The thumb pick of claim 1 wherein the biasing element is a coil spring wrapped around the pin.

8. The thumb pick of claim 7 wherein the coil spring is metallic.

9. The thumb pick of claim 1 wherein on an upstroke of the thumb pick on the guitar strings, the retaining ring pivots slightly away from the pick to give the musician more freedom in how he holds the pick.

10. The thumb pick of claim 7 wherein the biasing element is fixed about the pin between two of the knuckles that are fixed to the pick.

11. A thumb pick for a musician's thumb to strum guitar strings, comprising:

a pick having a front side, a rear side, a lower side terminating in a rounded point, and an upper side terminating at a pivot mechanism, the pick having a thickness of at least 0.8 mm;

a retaining ring having a concave inside surface, a convex outside surface, an upper side terminating at the pivot mechanism, and a lower side, the retaining ring being tapered to accommodate a slope of the musician's thumb;

the pivot mechanism including two or more knuckles fixed with the upper side of the pick, two or more knuckles fixed with the upper side of the retaining ring, and a pin traversing aligned apertures formed through the knuckles, the pivot mechanism further including a metallic coil spring that urges the retaining ring towards the pick and that is disposed between two of the knuckles that are fixed with the pick;

wherein at least one of the knuckles of the pick includes an extension stop to prevent the retaining ring from pivoting away from the pick beyond 15-degrees; and wherein at least one of the knuckles of the pick includes a retraction stop to prevent the retaining ring from contacting the pick;

whereby with the musician wearing the thumb pick encircling his thumb, he can strum the guitar strings with the pick.

12. A thumb pick for a musician's thumb to strum guitar strings, comprising:

a pick having a front side, a rear side, a lower side terminating in a rounded point, and an upper side terminating at a pivot mechanism;

a retaining ring having a concave inside surface, a convex outside surface, an upper side terminating at the pivot mechanism, and a lower side; and the pivot mechanism including two or more knuckles fixed with the upper side of the pick, two or more knuckles fixed with the upper side of the retaining ring, and a pin traversing aligned apertures formed through the knuckles, the pivot mechanism further including a biasing element that urges the retaining ring towards the pick, wherein a distal end, opposite the pivot mechanism, of the retaining ring points toward the front side of the pick;

whereby with the musician wearing the thumb pick encircling his thumb, he can strum the guitar strings with the pick.

13. The thumb pick of claim 12 wherein at least one of the knuckles of the pick includes an extension stop to prevent the retaining ring from pivoting away from the pick beyond a predetermined angle.

14. The thumb pick of claim 13 wherein the predetermined angle is less than about 25-degrees.

15. The thumb pick of claim 12 wherein at least one of the knuckles of the pick includes a retraction stop to reduce or eliminate pressure of the retaining ring against the pick.

16. The thumb pick of claim 12 wherein the pick has a thickness of at least 0.8 mm.

17. The thumb pick of claim 12 wherein the retaining ring is tapered to accommodate a slope of the musician's thumb.

18. The thumb pick of claim 12 wherein the biasing element is a coil spring wrapped around the pin.

19. The thumb pick of claim 18 wherein the coil spring is metallic.

20. The thumb pick of claim 12 wherein on an upstroke of the thumb pick on the guitar strings, the retaining ring pivots slightly away from the pick to give the musician more freedom in how he holds the pick.

* * * * *